US006389931B1

(12) United States Patent
Delaney et al.

(10) Patent No.: US 6,389,931 B1
(45) Date of Patent: May 21, 2002

(54) EXTENSION TO A DRIVER TOOL

(75) Inventors: Dana L. Delaney, Lancaster; Robert L. Arnold, Wrightsville; Kenneth Taggart, Columbia; James A. Van Lenten, Lancaster, all of PA (US)

(73) Assignee: Hand Tool Design Corporation, Wilmington, DE (US)

( * ) Notice: Subject to any disclaimer, the term of this patent is extended or adjusted under 35 U.S.C. 154(b) by 0 days.

(21) Appl. No.: 09/540,430

(22) Filed: Mar. 31, 2000

(51) Int. Cl.[7] ..... B25B 13/46
(52) U.S. Cl. ..... 81/60; 81/63; 81/177.2
(58) Field of Search ..... 81/60, 61, 62, 81/63, 63.1, 63.2, 177.2

(56) References Cited

U.S. PATENT DOCUMENTS 3,227,015 A 1/1966 Tremblay
4,502,365 A 3/1985 Hacker
4,856,388 A 8/1989 Freeman
5,794,496 A 8/1998 Arnold
5,857,390 A 1/1999 Whiteford
5,901,620 A 5/1999 Arnold
5,913,954 A 6/1999 Arnold et al.

*Primary Examiner*—Joseph J. Hail, III
*Assistant Examiner*—Joni B. Danganan
(74) *Attorney, Agent, or Firm*—Robert M. Gamson; Leonard Bloom

(57) ABSTRACT

An extension between a driving tool and a driven member which has a hollow body with external gear teeth on one end which is releasably retained in the driving tool. The second end of the body has internal teeth which cooperate with external teeth on the driven member. Also, in the second end of the body is a retaining ring to releasably retain the member to be driven. A sleeve is slidingly received in the body. The sleeve is longitudinally slidable within the body from a first position in which the sleeve is slid fully inwardly to eject the driven member and a second position in which the sleeve is slid outwardly from the body when the driven member is inserted.

30 Claims, 14 Drawing Sheets

EXTENSION TO A DRIVER TOOL

FIELD OF THE INVENTION

The present invention relates to an extension to a driver tool such as a ratchet wrench or breaker bar and more particularly to an extension for the ratchet wrench or breaker bar used with sockets having a plurality of gear teeth on an outer circumference thereof.

BACKGROUND OF THE INVENTION

Extensions for ratchet wrenches have been used to provide accessibility to fasteners in confined spaces in which the ratchet wrench cannot be used. U.S. Pat. Nos. 3,227,015; 4,502,365 and 4,856,388 disclose typical extensions which are known. These extensions are used with conventional wrenches with conventional sockets. U.S. Pat. Nos. 5,794,496; 5,901,620 and 5,913,954 issued to Arnold and U.S. Pat. No. 5,857,390 issued to Whiteford disclose a low profile wrench and sockets for the low profile wrench in which the sockets have a plurality of gear teeth formed axially on an outer circumference of the socket. These sockets are removably retained in the opening in the head of the wrench and the teeth on the sockets engage teeth on the pawl within the head of the wrench. An extension is needed for use with this low profile wrench since the conventional extension cannot be retained by the wrench, nor can the conventional extension receive the sockets with the external gear teeth.

BRIEF SUMMARY OF THE INVENTION

It is an object of the present invention to provide an extension to be used with a low profile wrench which has sockets having gear teeth formed axially on an outer circumference of the socket.

It is a further object of the present invention to provide an extension for a ratchet wrench or a breaker bar which can releasably retain a selected socket or a second extension with a selected socket on the end of the second extension.

It is another object of the invention to provide an extension for a ratchet wrench or breaker bar which can be used with fasteners having an elongated threaded shaft extending from the fastener.

In accordance with the teachings of the present invention, there is disclosed an extension between a driving tool and a member to be driven. The extension has a hollow body having a first end and a second end. Means are provided on the first end of the body for the extension to be releasably retained in the driving tool. Means are provided on the second end of the body to releasably retain the member to be driven. A sleeve is slidingly received within the hollow body. The sleeve has a first end having a flange formed thereon. The flange extends over the first end of the body. A second end of the sleeve is retained within the body. The sleeve is longitudinally slidable within the body between a first position in which the sleeve is fully inserted within the body and a second position in which the sleeve is slid outwardly from the body. The driven member may be ejected from the body by sliding the sleeve into the first position.

In further accordance with the teachings of the present invention, there is disclosed an extension between a driving tool and a member to be driven. The extension has a hollow body having a first end and an opposite second end. The first end has a circumferential groove formed thereabout. Retaining means in the driving tool engages the circumferential groove in the first end of the hollow body. A plurality of spaced-apart gear teeth are formed axially about an outer circumference of the first end of the body juxtapositioned to the circumferential groove. A plurality of spaced-apart teeth are formed internally on the inner circumference of the second end of the body. A sleeve is slidingly disposed within the hollow body. The sleeve has a first end having a flange formed thereon. The flange extends over the first end of the body. The sleeve has a flared second end such that the sleeve is retained within the body, being longitudinally slidable between a first position in which the sleeve is fully inserted into the body and a second position in which the sleeve is slid out of the body until restrained by the flared second end of the sleeve. A circumferential channel is formed internally in the body near to the plurality of teeth. A retaining ring is disposed in the channel. The spaced-apart teeth in the second end of the body are capable of receiving therein the member to be driven. Said member has a plurality of equi-spaced teeth formed axially on an end of the member. The member further has a circumferential groove formed thereabout above the equi-spaced teeth. The member may be received in the second end of the body, the teeth on the member engaging the internal teeth in the body and the groove on the member receiving the retaining ring in the body. The member may be ejected from the body by sliding the sleeve from the second position to the first position.

Additionally, in accordance with the teachings of the present invention, there is disclosed an extension between a driving tool and a member to be driven. The extension has, in combination, a hollow body having a first end and a second end. Means are provided on the first end of the body for the extension to be releasably retained in the driving tool. Means are provided on the second end of the body to releasably retain the member to be driven. A sleeve is slidingly received within the hollow body. The sleeve has a first end having a flange formed thereon, the flange extending over the first end of the body. A second end of the sleeve is retained within the body. The sleeve has a sidewall. At least one retaining tab and at least one friction tab is formed on the sidewall of the sleeve, and extend outwardly therefrom. The sleeve is longitudinally slidable within the body between a first position in which the sleeve is fully inserted within the body and a second position in which the sleet is slid outwardly form the body. The driven member may be ejected from the body by sliding the sleeve into the first position.

Further in accordance with the technique of the present invention, there is disclosed a combination with a low profile ratchet wrench, the wrench having a head portion formed with an opening. A pawl is provided with gear teeth projecting within the opening in the head portion of the ratchet wrench. A selected one of a plurality of wrench sockets is removably received within the opening. Each of the wrench sockets has external gear teeth meshing with the gear teeth on the pawl. An extension member has a pair of end portions, one of the end portions of the extension member being provided with external gear teeth meshing with the gear teeth on the pawl, and the other end portion of the extension member having a socket formed therein. The socket is provided with internal gear teeth meshing with the external gear teeth on the selected one of the wrench sockets.

These and other objects of the present invention will become apparent from a reading of the following specification taken in conjunction with the enclosed drawings.

BRIEF DESCRIPTION OF THE DRAWINGS

FIG. 28 shows in partial cut-away the extension body being placed in the head of the driving tool.

FIG. 29 shows the extension body retained in the head of the driving tool and the socket being inserted into the extension.

FIG. 30 shows the extension with the socket retained in the head of the driving tool ready for use.

FIG. 31 shows finger pressure on the flange on the sleeve releasing the socket from the extension.

FIG. 32 shows the extension being manually removed from the driving tool.

FIG. 33 shows the extension engaging the socket and being inserted into the head of the driving tool.

FIG. 34 shows, in partial cutaway, the extension, with the engaged socket, being retained in the head of the driving tool.

FIG. 35 shows finger pressure on the flange on the sleeve releasing the socket from the extension.

FIG. 36 shows further finger pressure on the flange on the sleeve releasing the extension from the head of the driving tool.

DESCRIPTION OF THE PREFERRED EMBODIMENTS

Figure 1:
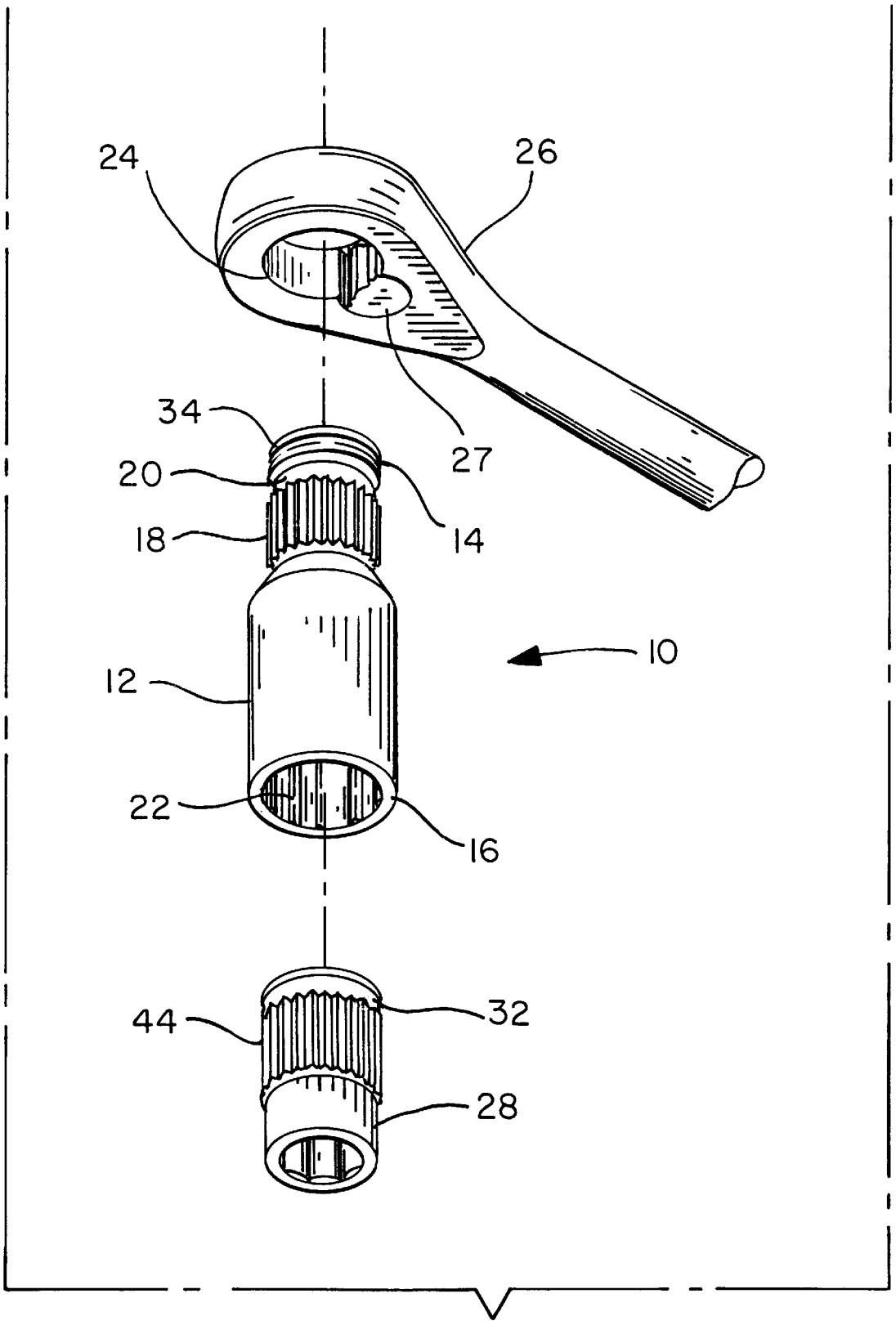
FIG. 1 is a perspective view of the extension of the present invention showing a ratchet wrench in which the extension is received and the socket which is driven by the extension.
Figure 2:
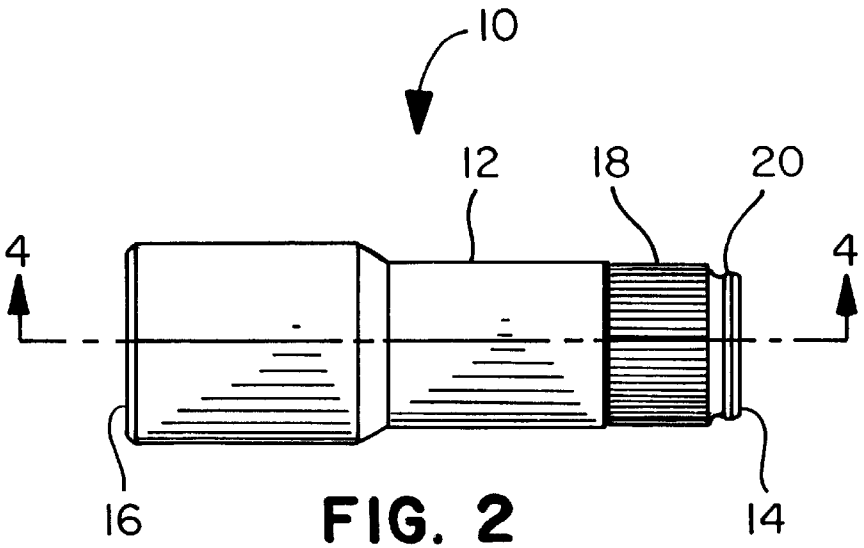
FIG. 2 is a top plan view of the body of the extension.
Figure 4:
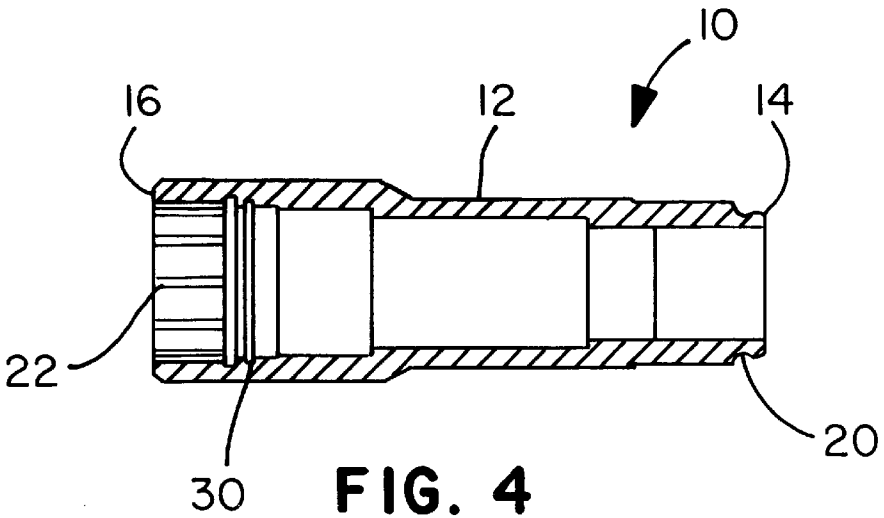
FIG. 4 is a cross section view taken across the lines 4—4 of FIG. 2.
Figure 3:
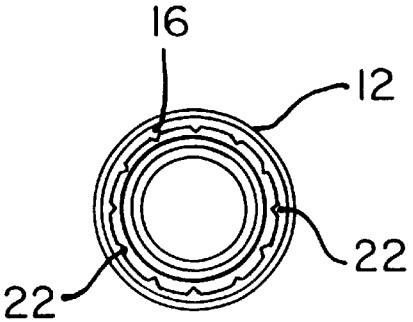
FIG. 3 is an end view of the body of the invention.

Referring now to FIGS. 1–4 the extension 10 has a hollow body 12 with a first end 14 and an opposite second end 16. On the outer circumference of the first end 14, there are formed a plurality of spaced-apart gear teeth 18. The gear teeth 18 are disposed axially on the body 12. A groove 20 is formed circumferentially on the first end 14 of the body, the groove being adjacent to the gear teeth 18 and distal from the second end 16 of the body. A plurality of spaced-apart teeth 22 are formed on the inner circumference of the second end 16 of the body. The number of teeth and the spacing between the teeth may be identical to the configuration of the gear teeth 18 on the first end 14 of the body 12 or there may be fewer teeth which have greater spacing between the teeth. The number of teeth and the spacing must be sufficient to engage gear teeth on a driven member (such as a socket) as will be described.

FIG. 1 shows the extension 10 to be received in the through opening 24 in the head of a driving tool 26 such as the ratchet wrench of U.S. Pat. Nos. 5,857,390 and 5,901,620. Preferably, the opening 24 has a first portion distal from the handle and a second portion proximal to the handle. A pawl 27 having teeth thereon is disposed in the second portion of the opening in the ratchet wrench 26 with the teeth communicating with the first portion of the opening in the head. When the extension 10 is inserted in the first portion of the opening 24 in the ratchet wrench, the teeth on the pawl 27 engage the gear teeth 18 on the extension 10 and permit ratcheting of the extension 10 by the ratchet wrench. Preferably, the pawl 27 is connected to a reversing lever (not shown) to obtain forward and reverse drive of the extension 10. Also shown being received in the second end 16 of the body 12 is a member to be driven 28 such as a geared tooth socket as disclosed in U.S. Pat. Nos. 5,819,606; 5,857,390 and 5,901,620. The socket 28 has a first axial portion and a second axial portion integral thereto. The first axial portion has an opening formed therein. The opening has surfaces formed axially therein. The surfaces engage a fastener of a predetermined size. The surfaces are of a type known to persons skilled in the art and may be of a conventional six point, eight point or twelve point type. Depending on the size of the opening required to fit a fastener of a predetermined size wherein the size of the fastener may vary, the diameter of the first axial portion of the socket may vary from socket to socket. The second axial portion of the socket has an end distal from the first portion of the socket. An annular shoulder is formed on the end. A plurality of gear teeth 44 defining a gear toothed socket are formed externally, axially and circumferentially on the second portion of the socket 28. In the sockets in which the first axial portion is of a size to fit a large fastener, the diameter of the first axial portion is greater than the diameter of the ratchet gear on the second axial portion. An external annular groove 32 is formed between the annular shoulder and the geared tooth socket on the second axial portion of the socket. An opening is formed in the second axial portion of the socket 28. The opening in the second axial portion communicates with the opening in the first axial portion to form a through opening in the socket.

Figure 7:
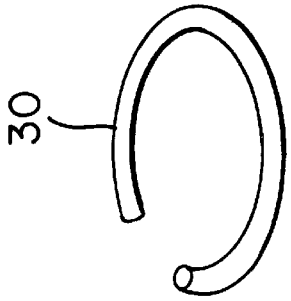
FIG. 7 is a perspective view of a "C" type retaining ring.
Figure 6:
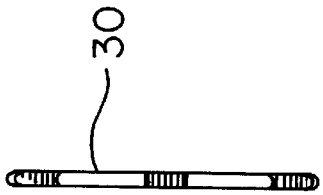
FIG. 6 is a side view of the retaining ring of FIG. 5.
Figure 5:
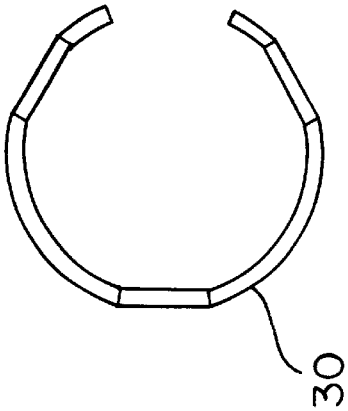
FIG. 5 is a top plan view of the retaining ring which is disposed in the body of the extension.

A retaining ring 30 (FIGS. 5–7) is disposed in a circumferential channel 31 (FIGS. 10–12) internally between the first end 14 and the second end 16 of the body 12 and proximal to the teeth 22 in the second end 16 of the body 12. The retaining ring 30 releasably engages a circumferential groove 32 in the driven member 28 as will be described.

Figure 9:
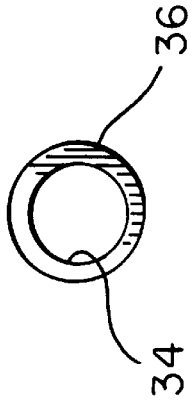
FIG. 9 is an end view of the sleeve of the extension showing the flange.
Figure 8:
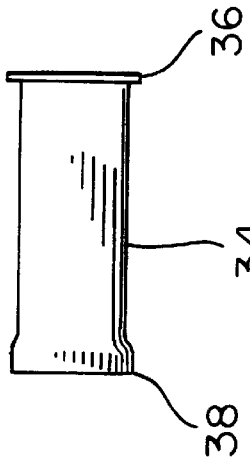
FIG. 8 is a top plan view of the sleeve of the extension.
Figure 10:
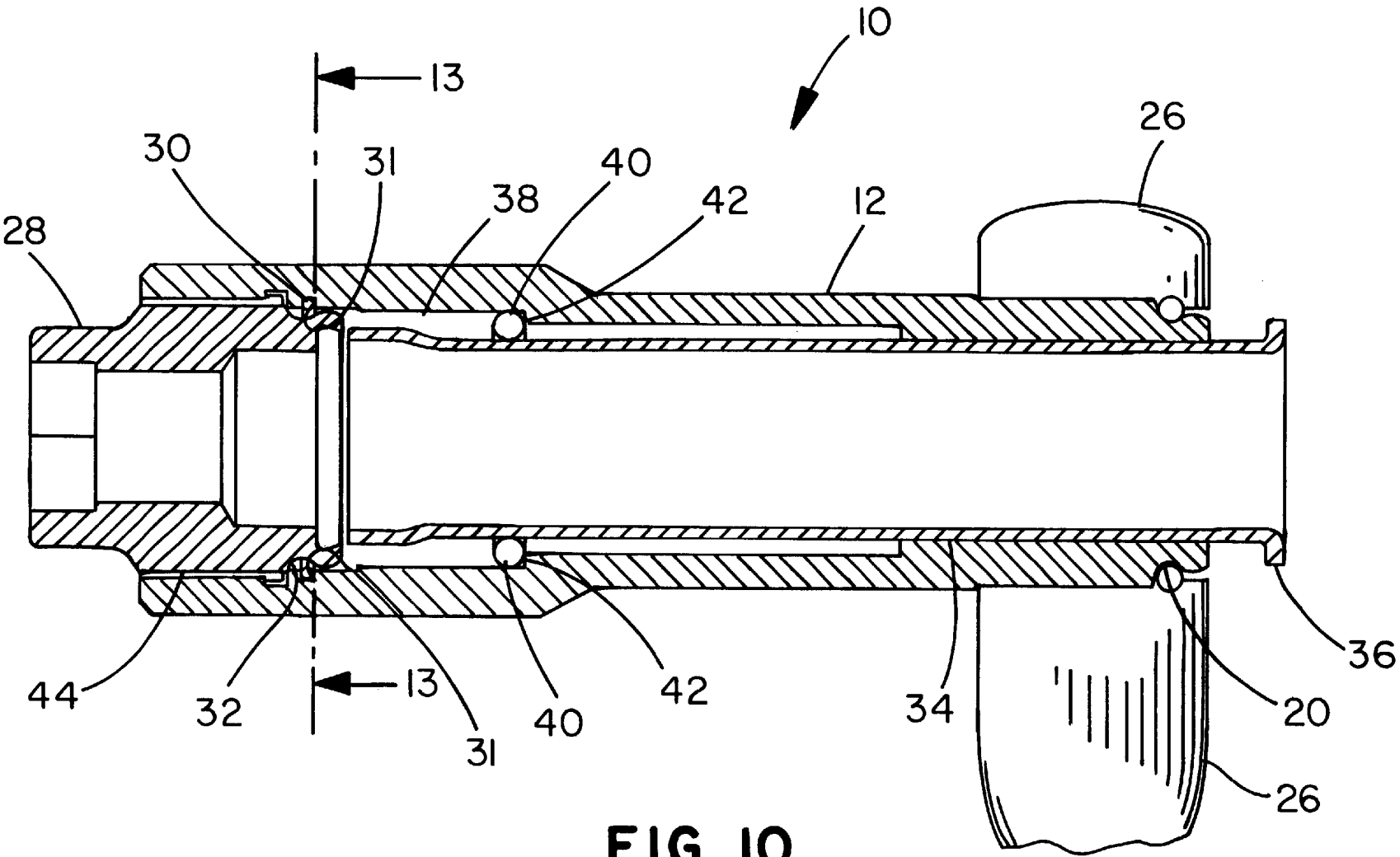
FIG. 10 is a cross-section view of the extension with a socket retained in the second end of the body and the sleeve separated from the socket.
Figure 12:
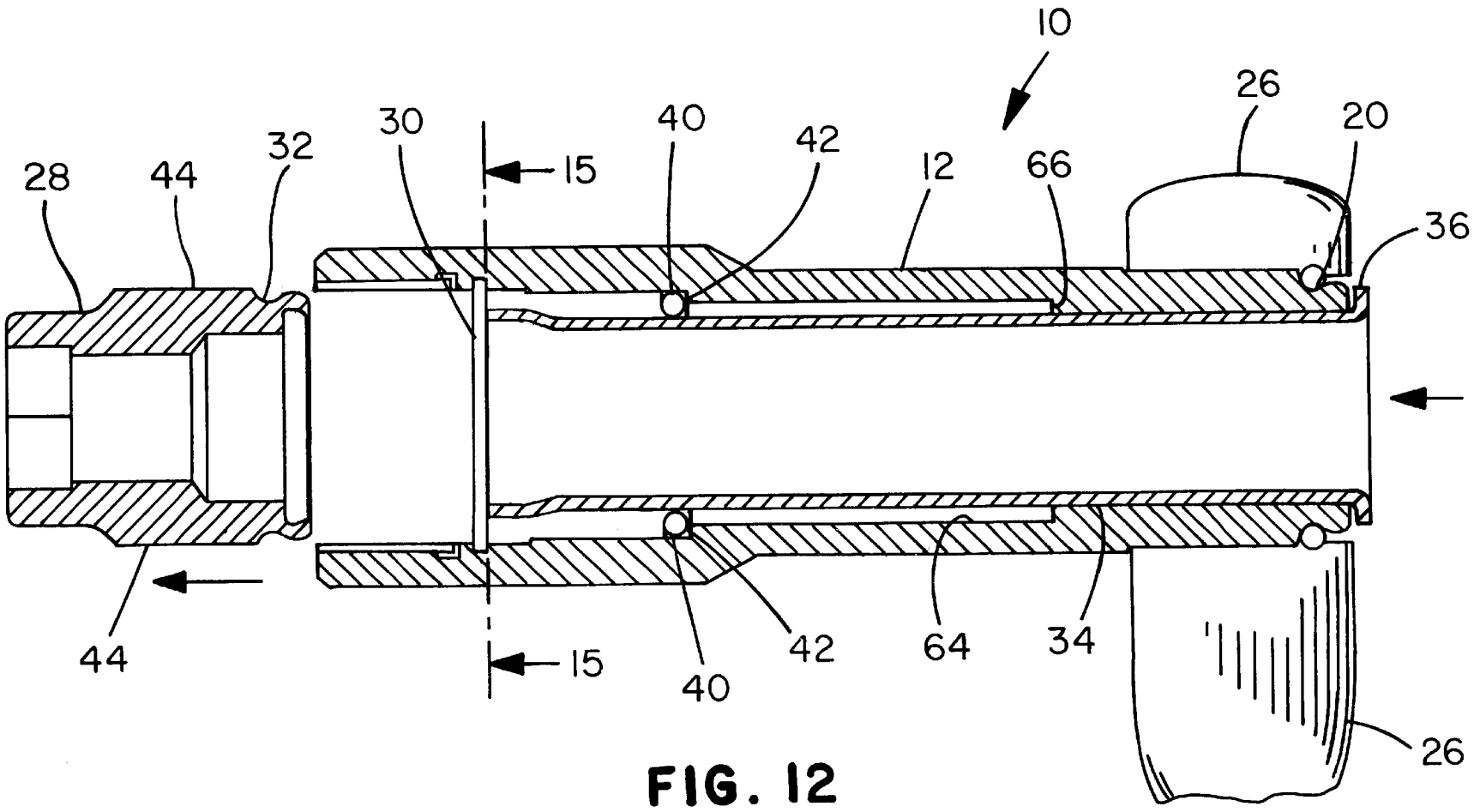
FIG. 12 is a cross-section view of the extension showing the sleeve slid into the body and the socket ejected.

A sleeve 34 (FIGS. 8 and 9) is slidingly received within the hollow body 12. A flange 36 is formed on a first end of the sleeve and disposed outwardly and over the first end 14 of the body 12. The second end 38 of the sleeve 34 preferably is flared and retained within the hollow body 12. The sleeve 34 is longitudinally slidable within the body from a first position to a second position (FIGS. 12 and 10). In the first position, the sleeve 34 is fully inserted into the hollow body 12 such that the flange 36 on the first end of the sleeve 34 abuts the first end 14 of the body 12 above the circumferential groove 20. The flared second end 38 of the sleeve 34 is disposed adjacent to the retaining ring 30 within the body 12. In the second position, the sleeve 34 is slid outwardly from the body, the flange 36 on the first end of the sleeve 34 being extended outwardly from the first end 14 of the body 12 and the flared second end 38 of the sleeve 34 being moved toward the first end 14 of the body 12 and spaced apart from the retaining ring 30 in the body 12.

An O ring 40 may be disposed between the sleeve 34 and the internal wall of the hollow body 12. (FIGS. 10–12) Preferably an internal ridge or step 42 is formed on the internal wall of the body 12 against which the O ring 40 abuts. The O ring 40 serves as a source of friction when the sleeve 34 is slid either direction within the body between the second and first position. The O ring 40 also serves to center the sleeve 34 within the hollow body 12 and to absorb any lateral movement of the sleeve 34 due to tolerance extremes of the components.

The extension 10 of the present invention is for use with a driving tool 26 and a driven member 28 which are not the conventional ratchet wrench and socket. The driving tool 26 is similar to the ratchet wrench disclosed in U.S. Pat. Nos. 5,794,496; 5,857,340; 5,901,620 and 5,913,954 which has a through opening in the head and a pawl with teeth which communicate with the through opening. Also, a retaining means is disposed in the through opening. Preferably, the retaining means is a retaining ring which engages the circumferential groove 20 in the first end 14 of the body 12. The teeth on the pawl in the driving tool engage and cooperate with the gear teeth 18 on the outer circumference of the first end 14 of the body 12. If the pawl in the driving member is reversed, the extension 10 is similarly reversed in direction of rotation.

In a like manner, the driven member 28 preferably is a gear toothed socket having a plurality of spaced-apart gear teeth 44 on an outer circumference as disclosed in U.S. Pat. Nos. 5,819,606; 5,857,390 and 5,901,620. The gear teeth 44 on the driven member 28 are identical in size, shape and spacing to the gear teeth 18 on the first end 14 of the body 12 such that the driven member 28 (or socket) could be used with the driving member 26 (or ratchet wrench).

The gear teeth 44 on the driven member 28 engage the teeth 22 in the second end of the body 12 such that when the extension 10 is driven by the driving tool 26, the forces are transmitted directly to the driven member 28. The circumferential groove 32 in the driven member engages the retaining ring 30 in the body and the driven member is releasably retained in the second end 16 of the body 12. The retention means is similar to the retention means in the driving tool 26 such that the driving tool can be used interchangeably with the driven member 28 (socket) or the extension 10.

Figure 13:
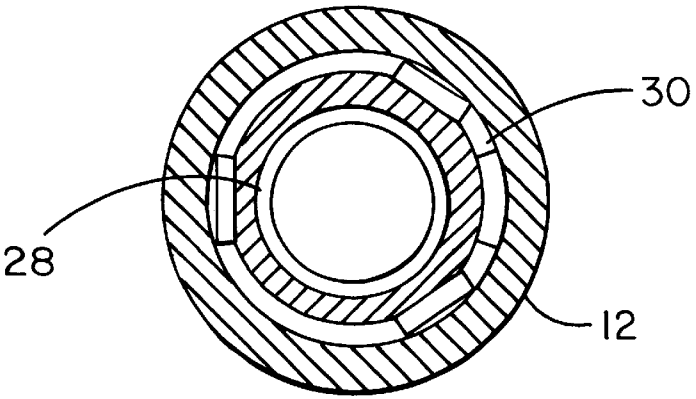
FIG. 13 is a cross-section view taken across the lines 13—13 of FIG. 10.

When the extension 10 is disposed in the head of the driving tool 26 and retained therein by the retaining means, the driven member 28 is introduced into the second end 16 of the extension 10. The retaining ring 30 in the body engages the circumferential groove 32 on the driven member and the driven member is retained in the body. As shown in FIG. 10, the introduction of the driven member 28, slidingly moves the sleeve 34 into the second position when the top of the driven member 28 contacts the flared end 38 of the sleeve 34. The flange 36 on the first end of the sleeve 34 is moved outwardly from the extension 10 and extends above the upper surface of the driving tool. The flange has a diameter less than the diameter of the opening in the head of the driving tool. Alternately the driven member 28 could be inserted into the second end 16 of the body 12 and the extension 10 with the connected driven member could be introduced into the opening 24 in the head of the driving tool 26. The retaining ring 30 is deposed within the channel 31 in the body 12 and also in the groove 32 in the driven member 28. The channel 31 and the groove 32 are directly opposed to one another and provide an opening in which the retaining ring 30 is in a normal condition, neither compressed nor expanded (FIG. 13).

To remove the extension 10 and the driven member 28 from the driving tool 26, manual pressure is applied on the extending flange 36. Depending upon the relative tension of the retaining means in the opening in the driving tool compared to the retaining ring 30 in the body 12, either the extension with the driven member 28 will be released from the driving tool 26 or the driven member 28 will be released from the extension 10 and the extension will remain in the head of the driving tool to be released by additional manual pressure on the flange 36.

Figure 11:
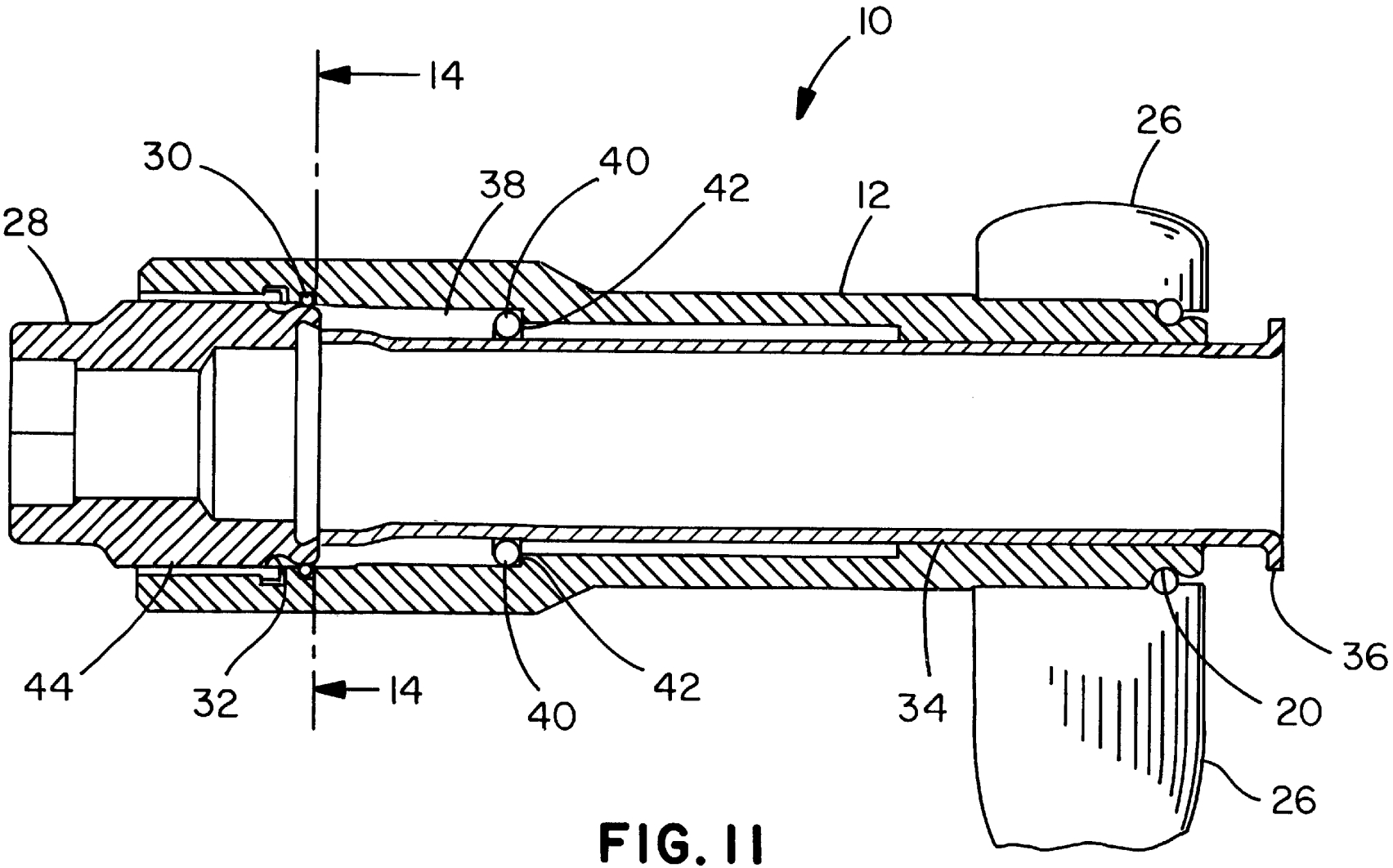
FIG. 11 is a cross-section view of the extension showing the sleeve pushing the socket past the retaining ring.
Figure 14:
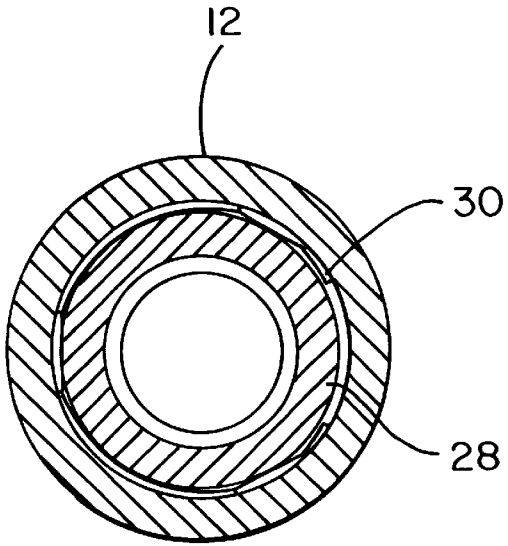
FIG. 14 is a cross section view taken across the lines 14—14 of FIG. 11.
Figure 15:
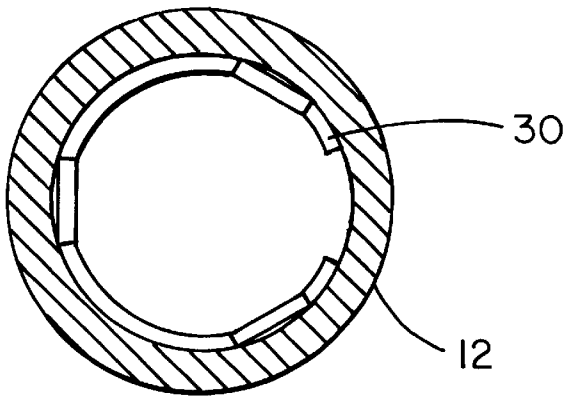
FIG. 15 is a cross-section view taken across the lines 15—15 of FIG. 12.

As shown in FIG. 11, pressure on the flange 36 slidingly moves the sleeve 34 until the flared second end 38 of the sleeve contacts the top of the driven member 28 and overcomes the force between the retaining ring 30 and the groove 32 in the driven member 28. FIG. 14 shows that further pressure on the flange 36 moves the driven member 28 outwardly from the body 12 such that the retaining ring 30 is pressed into the channel 31 and displaced from the groove 32 in the driven member. As shown in FIG. 12, the driven member 28 is ejected from the extension and further sliding movement of the sleeve 34 is terminated when the flange 36 abuts the first end 24 of the body 12. FIG. 15 shows the expanded retaining ring 30 in its normal, uncompressed condition in the channel 31 in the body 12 when no driven member 28 is in the body 12.

Figure 16:
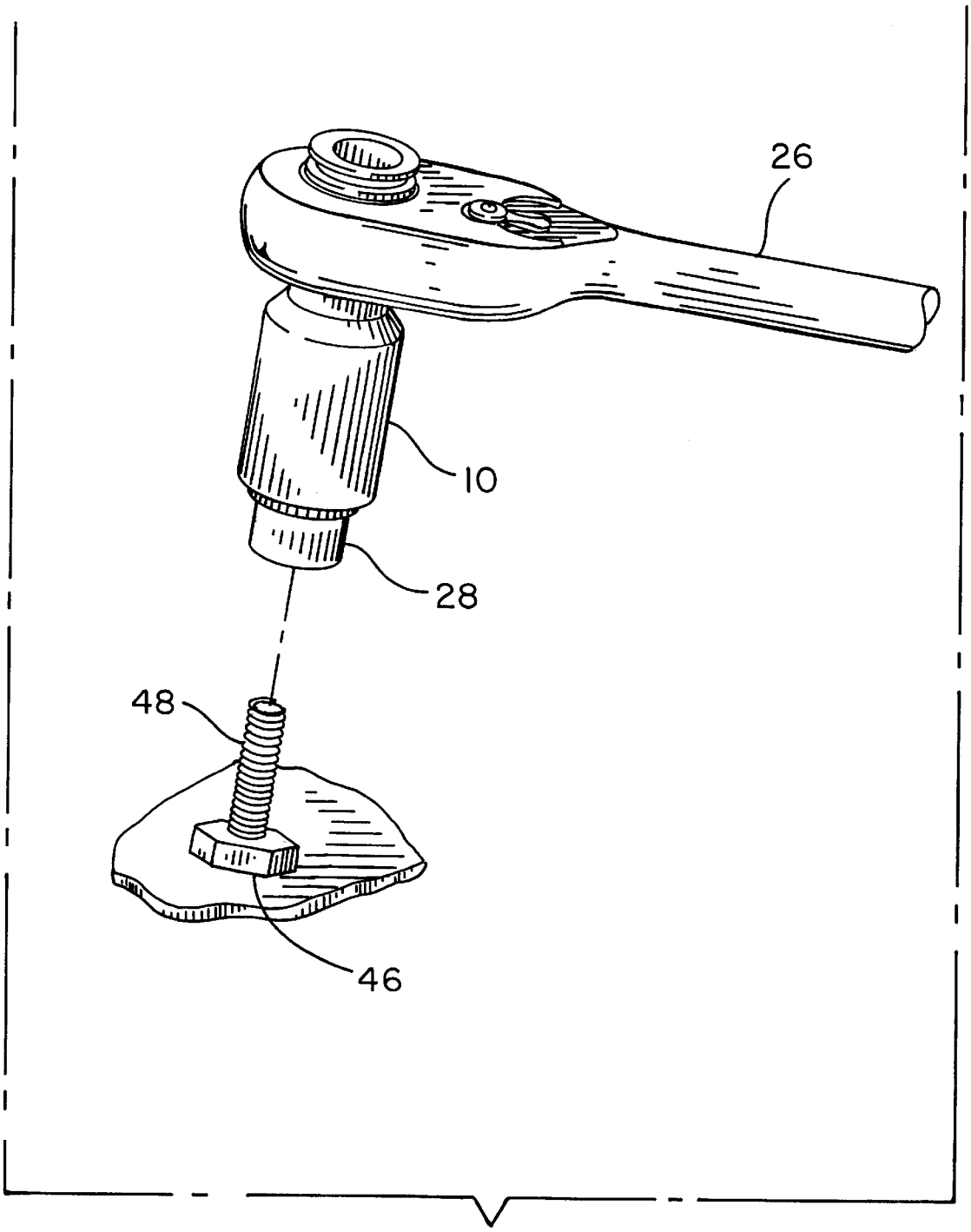
FIG. 16 is a perspective view of the extension retained in a ratchet wrench and connected to a socket being used with a fastener having an elongated shaft extending outwardly from the fastener.
Figure 17:
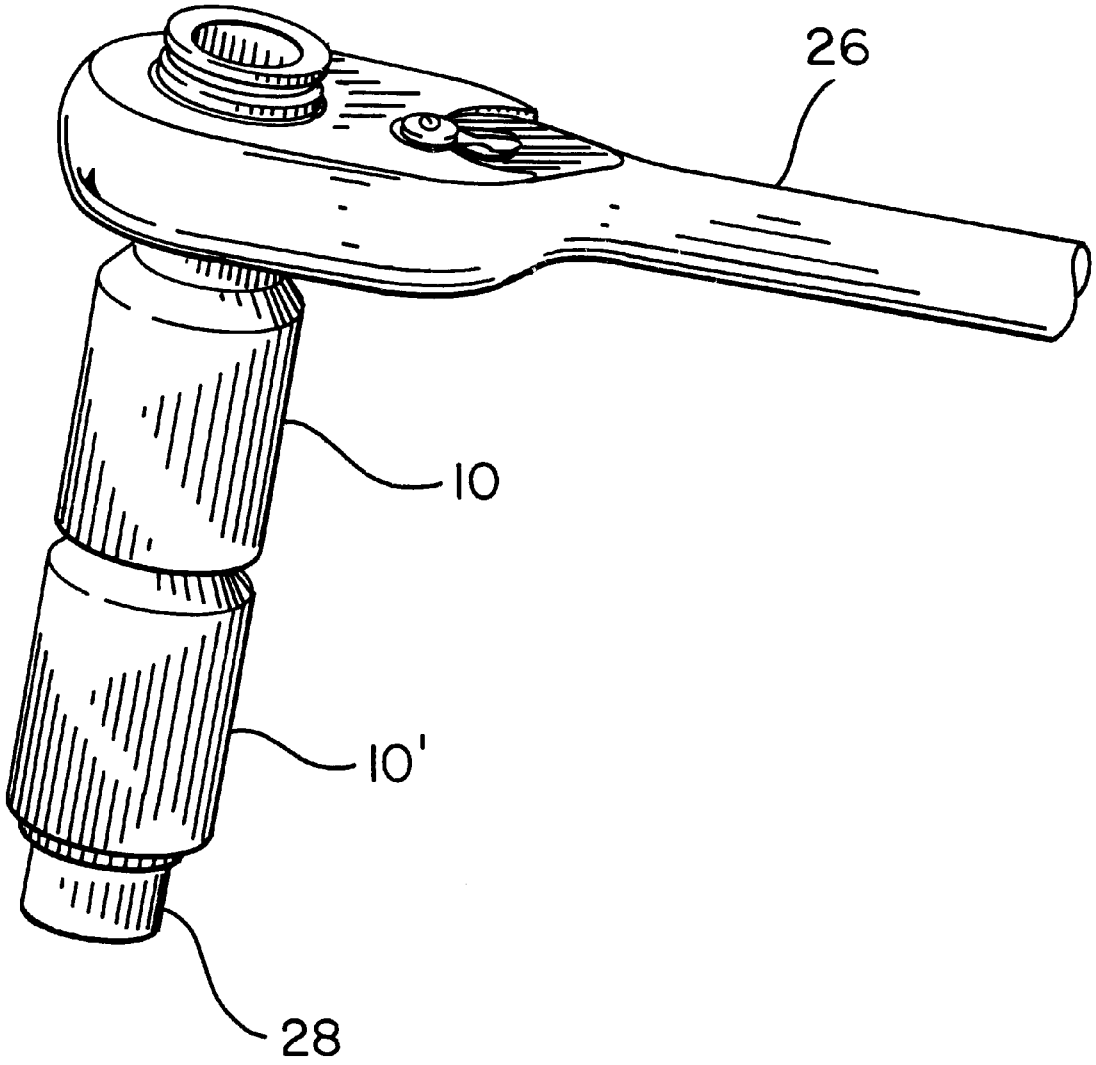
FIG. 17 is a perspective view of a ratchet wrench to which are connected two extensions.

The extension 10 may connect the driving tool to a driven member such as a socket as in FIG. 16 or, the driven member may be another identical extension 10' as in FIG. 17. The second extension 10' may then be connected to a socket. This configuration may be used to enable a user to reach a more distant fastener which, otherwise, is inaccessible.

Figure 18:
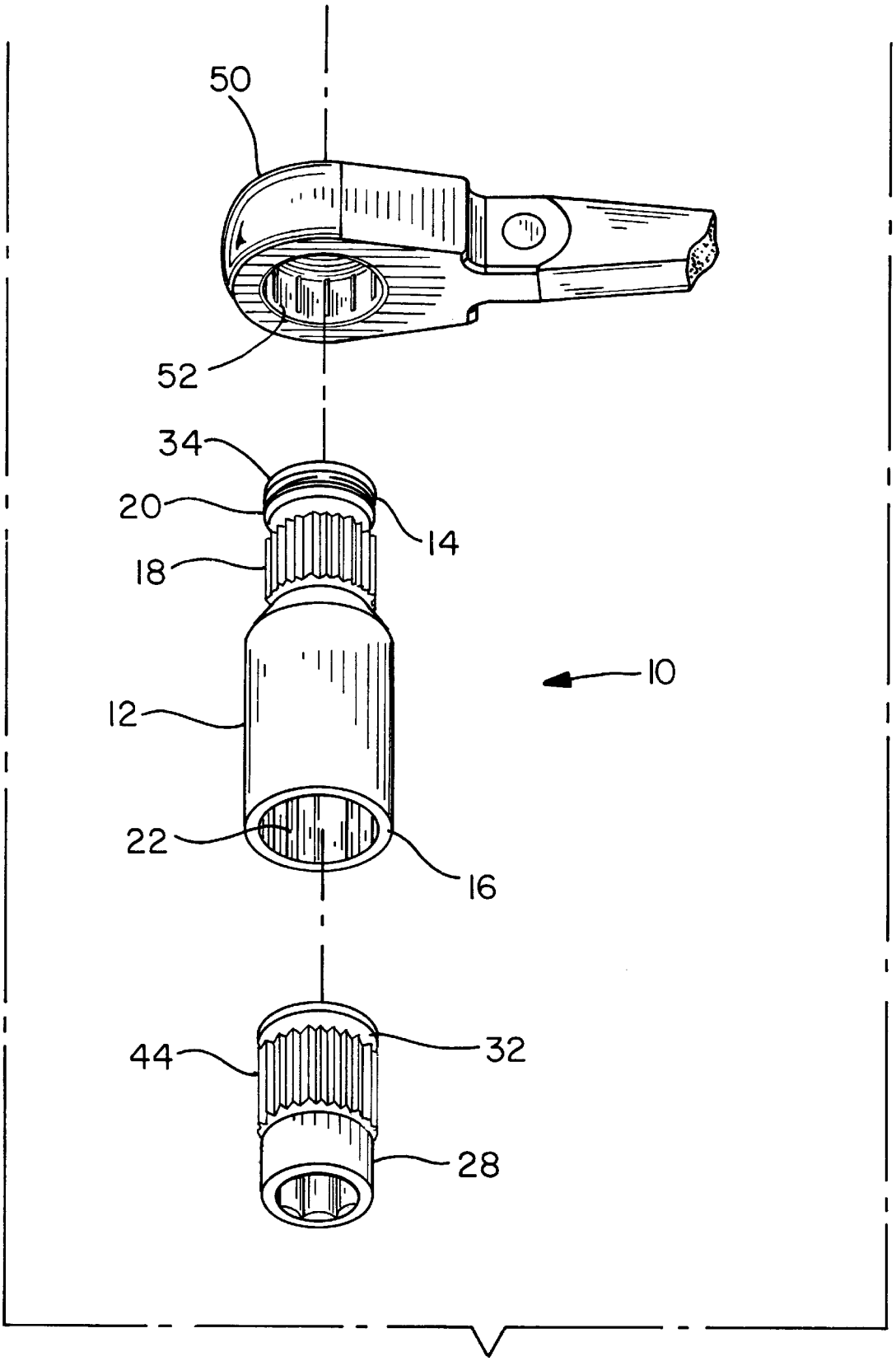
FIG. 18 is a perspective view of the extension of the present invention showing a breaker bar in which the extension is received and the socket which is driven by the extension.
Figure 21:
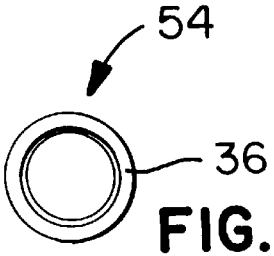
FIG. 21 is a top end view of FIG. 19.
Figure 19:
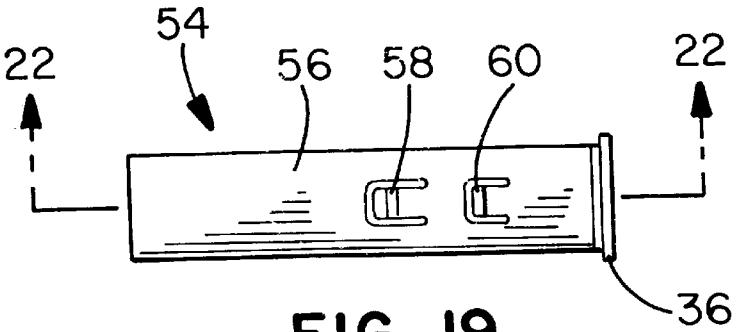
FIG. 19 is a side elevation view of an alternate embodiment of the sleeve.
Figure 20:
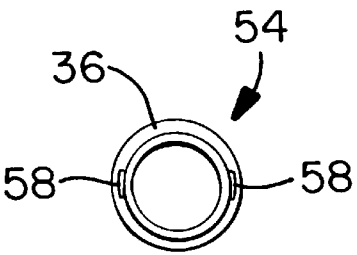
FIG. 20 is a bottom end view of FIG. 19.
Figure 23:
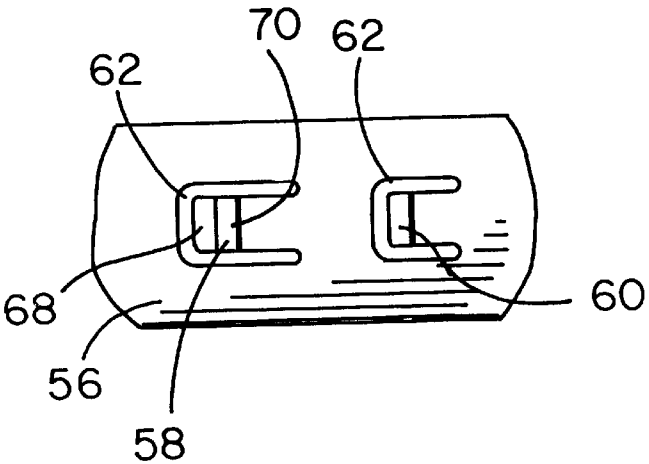
FIG. 23 is an enlarged view of a portion of FIG. 19.
Figure 22:
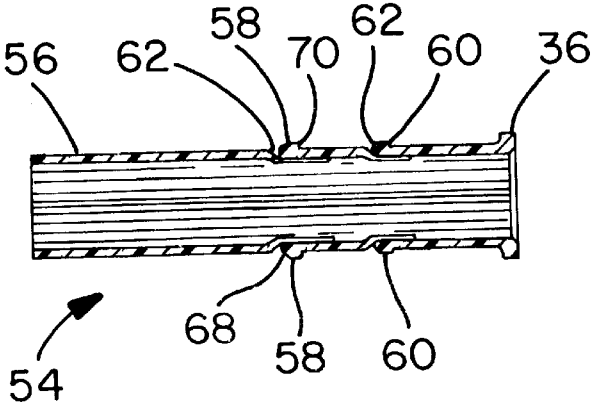
FIG. 22 is a cross section view taken across the lines 22—22 of FIG. 19.
Figure 24:
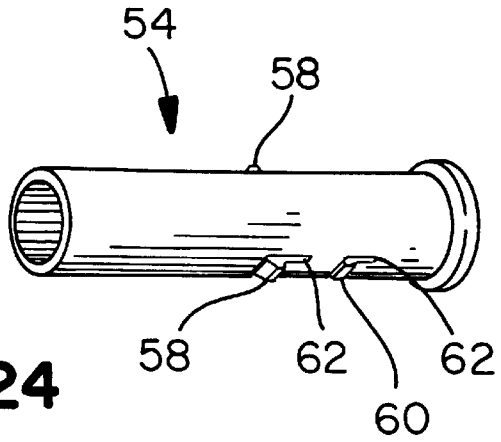
FIG. 24 is a perspective view of the alternate embodiment of the sleeve.
Figure 25:
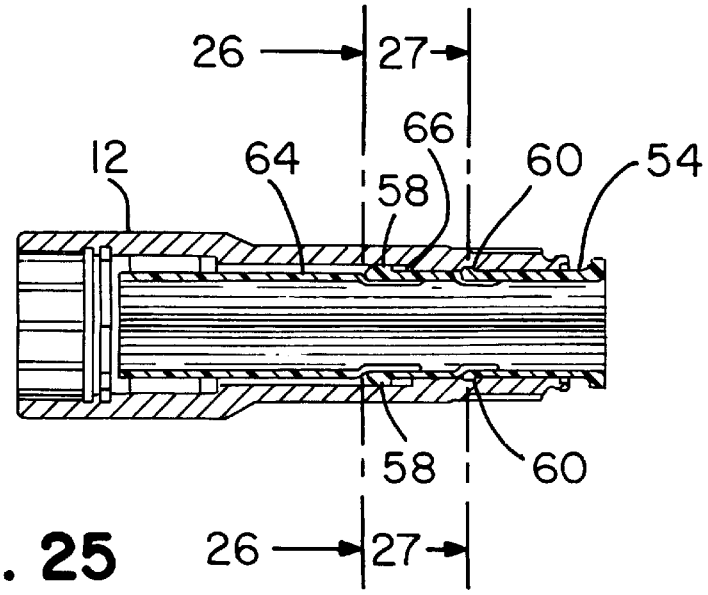
FIG. 25 is a cross sectional view of the alternate embodiment of the sleeve disposed in the hollow body.
Figure 26:
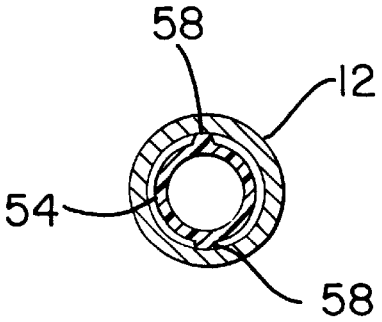
FIG. 26 is a cross section view taken across the lines 26—26 of FIG. 25.
Figure 27:
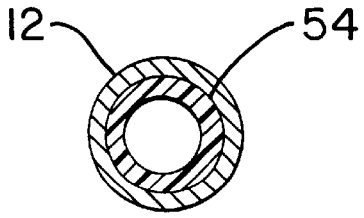
FIG. 27 is a cross section view taken across the lines 27—27 of FIG. 25.
Figure 30:
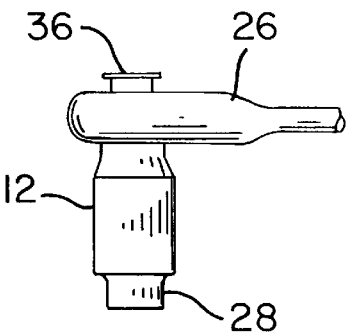
FIGS. 28–32 are a sequence of elevation views showing the insertion and removal of the present invention from a driving tool.
Figure 32:
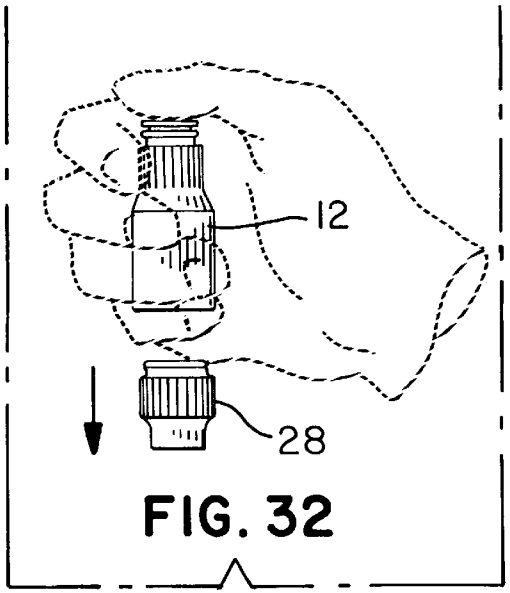
Figure 29:
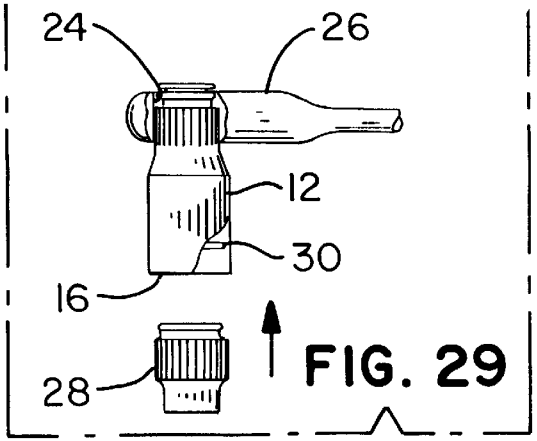
Figure 31:
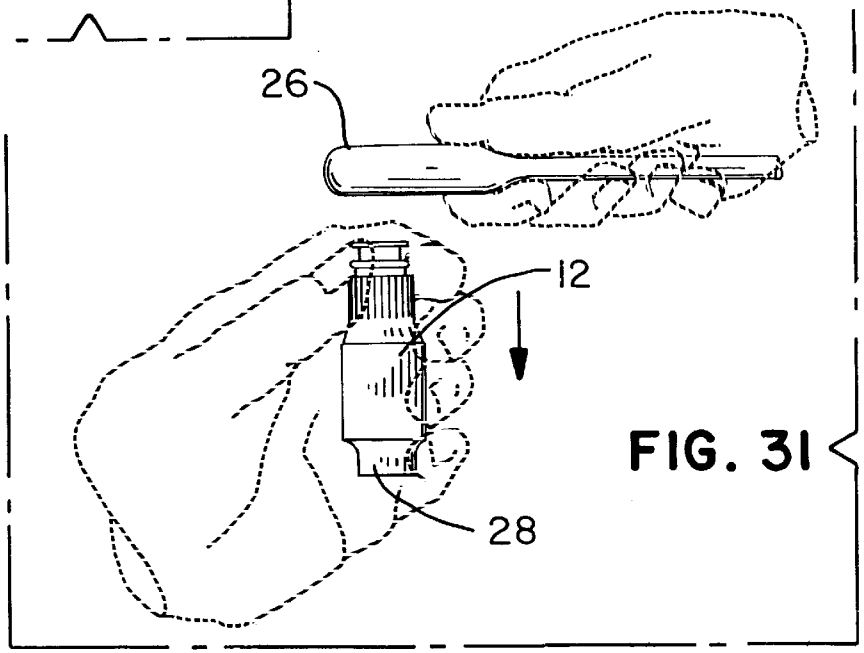
Figure 28:
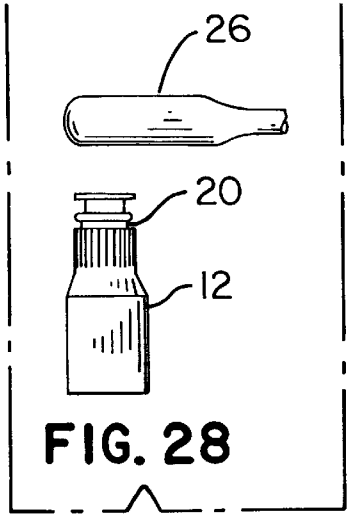
Figure 35:
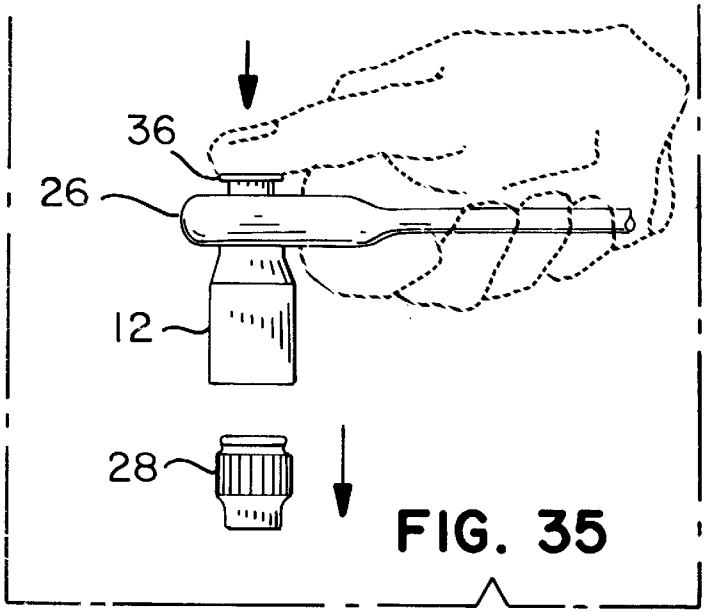
FIGS. 33–36 are a sequence of elevation views showing an alternate method for insertion and removal of the present invention from the head of the driving tool.
Figure 34:
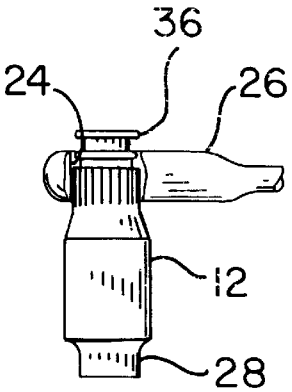
Figure 33:
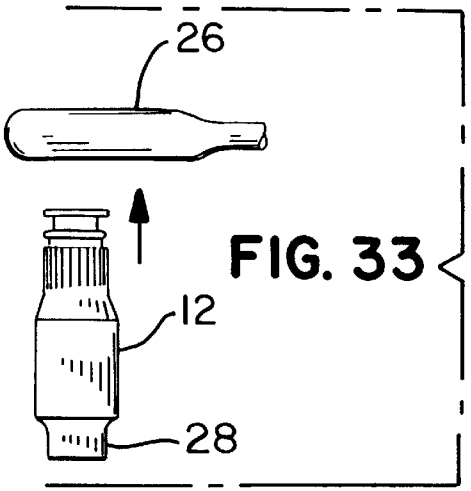
Figure 36:
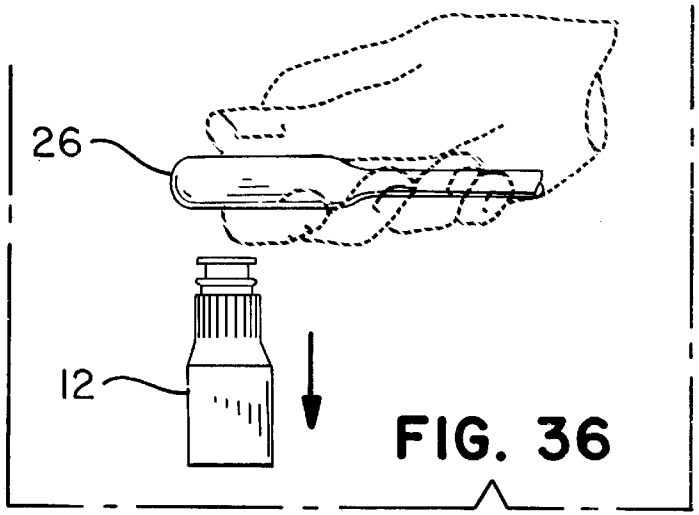

The driving tool may be a breaker bar 50 (FIG. 18) which has no pawl but has an opening in the head with a plurality of equi-spaced teeth 52 formed circumferentially therein. The teeth 52 in the head of the breaker bar 50 cooperate with the teeth 18 on the exterior of the first end of the extension 10. A retaining means is disposed in the opening in the head. The retaining means, which may be a retaining ring but is not so limited, engages the circumferential groove 20 in the first end 14 of the body 12.

In an alternate embodiment (FIGS. 19–27), the sleeve 54, preferably, is formed of plastic. On the sidewall 56 of the sleeve 54, there is formed at least one retaining tab 58 and at least one friction tab 60. Preferably, two or more retaining tabs 58 and two or more friction tabs 60 are formed, spaced circumferentially about the sleeve 54. The retaining tabs 58 and the friction tabs 60 extend outwardly from the sidewall 56 with the retaining tabs 58 extending farther outward than the friction tabs 60. Also, it is preferred that a U-shaped slot 62 be formed in the sidewall 56 about each of the retaining tabs 58 and friction tabs 60 to provide flexing and deflection of the respective tabs as will be described. The base of the U-shaped slot 62 is adjacent to the outwardly extending position of the respective retaining tabs 58 and friction tabs 60. Thus, the retaining tab 58 and friction tab 60 are connected to the sleeve 54 by a segment which acts as a spring.

The internal wall 64 of the hollow body 12 has at least one step 64 formed therein such that the internal diameter of the hollow body 12 is smaller proximal to the first end 14 of the body than the diameter distal from the first end 14. When the sleeve 54 is introduced into the first end 14 of the body 12, the leading edge 68 of the retaining tab 58, which is ramped from the sidewall 56 of the sleeve 54, passes over the at least one step 64 and is flexed inwardly about the slot 62 to deflect the retaining tab 58 so that the retaining tab 58 passes the step 66. After passing the step 66, the retaining tab 58 returns to its former unstressed position such that the perpendicular trailing edge 70 is opposed to the step 66. When the sleeve 54 is moved outwardly from the first end 14 of the body 12, the extent of movement is limited when the trailing edge 70 of the retaining tab 58 abuts the step 66. In this manner, the sleeve 54 is retained in the body 12. Although one retaining tab 58 is sufficient to retain the sleeve 54 within the body 12, it is preferred that two or more retaining tabs 58 be provided to assure retention and to reduce angular or lateral movement of the sleeve 54 within the body 12.

The friction tabs 60 do not extend outwardly from the sidewall 56 of the sleeve 54 as far as the retaining tabs 58. The friction tabs 58 are disposed on the sleeve 54 between the retaining tab 58 and the flange 36 on the first end of the sleeve 54. In this location, the friction tabs 60 are in direct contact with the internal wall 64 in the body where the diameter is the smallest. The U-shaped slot 62 provides a flexibility and a resiliency to the friction tab 60 to produce friction between the internal wall 64 of the body and the sleeve 54. In this manner, the sleeve 54 does not move unless force is applied to the flange or the second end of the sleeve to move the sleeve into, or out of, the body. It is preferred that at least two friction tabs 60 be provided to reduce lateral movement of the sleeve and to generate sufficient friction for controlled sliding movement of the sleeve 54.

In the above-described alternate embodiment, there is no need for an O ring 40 since the friction tabs 60 provide sufficient friction force.

U.S. Pat. No. 4,328,720 to Shiel discloses a socket wrench which has a set of replaceable sockets. The replaceable sockets do not have gear teeth formed on the outer circumference of the socket, rather the sockets are received in a recoverable drive ring. Further disclosed is an ejection member to remove the sockets. The ejection member operates against the pressure of a spring. The device is not an extension.

A further advantage of the extension 10 of the present invention is that the body 12 is hollow such that when used with a driven member (socket) 28 having a through opening and a driving tool (ratchet wrench) 26, having a through opening, the entire configuration has a communicating center opening. Thus, as shown in FIG. 16, the system can be used effectively with a fastener 46 having an elongated threaded shaft 48 extending outwardly from the fastener 46. In this manner, the extension adds versatility to the driving tool and driven member.

FIGS. 28–32 are a sequence showing one method of using the extension of the present invention. The body 12 is inserted into the opening in the head of the driving tool 26 and it is retained therein by the engagement of the groove 20 in the first end 14 of the body 12 by the retaining ring in the opening 24 in the head of the driving tool. The gear toothed socket 28 is inserted into the second end 16 of the body 12 and retained therein by the retaining ring 30. The extension holding the socket is ready for use. To remove the extension with the socket, the extension is manually grasped and pulled apart from the driving tool. The socket is released from the body by holding the socket and manually pressing against the flange in the sleeve.

FIGS. 33–36 are a sequence showing an alternate method for insertion and removal of the present invention from the head of a driving tool. The socket 28 is inserted into the body 12 and the body is inserted into the opening 24 in the head of the driving tool 26 where it is retained as described above. The extension holding the socket is ready for use. To remove the extension with the socket, finger pressure is applied to the flange 36 on the sleeve which extends above the top surface of the driving tool. The socket 28 is released from the body 12. Further finger pressure on the flange 36 releases the body 12 from the driving tool 26.

Combinations of the above sequences can be used to insert the socket into the body before or after the body is retained in the driving tool. Similarly, the sequence can be modified to release either the socket from the body or the body with the socket from the driving tool. Release can be effected by two handed manual operations or by finger pressure on the flange on the sleeve. The device of the present invention is versatile and can be used as desired by the user.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An extension between a driving tool and a member to be driven, the extension comprising, in combination:

a hollow body having a first end and a second end, means on the first end of the body for the extension to be releasably retained in the driving tool, means on the second end of the body to releasably retain the member to be driven, a sleeve being slidingly received within the hollow body, the sleeve having a first end having a flange formed thereon, the flange extending over the first end of the body, a second end of the sleeve being retained within the body, the sleeve being longitudinally slidable within the body between a first position in which the sleeve is fully inserted within the body and a second position in which the sleeve is slid outwardly from the body, and wherein the driven member may be ejected from the body by sliding the sleeve into the first position.

2. The extension of claim 1, wherein a plurality of equi-spaced teeth are formed axially about the outer circumference of the first end of the body, the driving tool having cooperating teeth formed therein such that force may be transmitted from the driving tool to the extension.

3. The extension of claim 1, wherein the means on the first end of the body for the extension to be retained in the driving tool is a circumferential groove formed on the first end of the hollow body.

4. The extension of claim 1, wherein a plurality of equi-spaced teeth are formed axially about an outer circumference of the first end of the body such that the first end of the body may be driven by the driving tool.

5. The extension of claim 1, wherein a plurality of equi-spaced teeth are formed on the inner circumference of the second end of the body such that the member to be driven may be driven by the extension.

6. The extension of claim 5, wherein a circumferential channel is formed internally in the body near to the plurality of teeth, a retaining ring being disposed in the channel, such that the driven member engages the retaining ring and is retained in the extension.

7. The extension of claim 1, wherein the driving tool is a ratchet wrench.

8. The extension of claim 1, wherein the driving tool is a breaker bar.

9. The extension of claim 1, wherein the driven member is a gear toothed socket.

10. The extension of claim 1, wherein the driven member is an extension.

11. The extension of claim 1, further comprising an O ring disposed between the sleeve and the body.

12. The extension of claim 1, wherein the member to be driven has a center opening therethrough, the center opening communicating with the hollow body, such that the member and extension may be used with a fastener having an elongated threaded shaft extending outwardly from the fastener, the threaded shaft being received in the hollow body of the extension.

13. The extension of claim 1, wherein the sleeve has a sidewall, the sidewall having formed thereon at least one retention tab and at least one friction tab.

14. An extension between a driving tool and a member to be driven, the extension comprising in combination:

a hollow body having a first end and an opposite second end, the first end having a circumferential groove formed thereabout, retaining means in the driving tool engaging the circumferential groove in the first end of the hollow body, a plurality of equi-spaced gear teeth being formed axially about an outer circumference of the first end of the body juxtapositioned to the circumferential groove, a plurality of equi-spaced teeth being formed internally on the inner circumference of the second end of the body, a sleeve being slidingly disposed within the hollow body, the sleeve having a first end having a flange formed thereon, the flange extending over the first end of the body, the sleeve having a flared second end such that the sleeve is retained within the body, being longitudinally slidable between a first position in which the sleeve is fully inserted into the body and a second position in which the sleeve is slid out of the body until restrained by the flared second end of the sleeve, a circumferential channel being formed internally in the body adjacent to the plurality of teeth, a retaining ring being disposed in the channel, the spaced-apart teeth in the second end of the body being capable of receiving therein the member to be driven, said member having a plurality of spaced-apart teeth formed axially on an end of the member, the member further having a circumferential groove formed thereabout above the spaced-apart teeth, wherein the member may be received in the second end of the body, the teeth on the member engaging the internal teeth in the body and the groove on the member receiving the retaining ring in the body, and the member may be ejected from the body by sliding the sleeve from the second position to the first position.

15. The extension of claim 14, wherein the member to be driven is a geared tooth socket.

16. The extension of claim 14, wherein the member to be driven is an extension.

17. The extension of claim 14, wherein the driving tool is a ratchet wrench having a head with a through opening therein, means within the through opening to engage the circumferential groove on the first end of the extension.

18. The extension of claim 14, wherein the driving tool is a breaker bar having a head with an opening therein, a plurality of equi-spaced teeth formed within the opening, the teeth in the head cooperating with the equi-spaced teeth on the first end of the body, a retaining means being disposed within the opening to engage the circumferential groove on the first end of the hollow body.

19. The extension of claim 14, further comprising a resilient O ring disposed between the body and the sleeve.

20. The extension of claim 14, wherein the member to be driven has a center opening therethrough, the center opening communicating with the hollow body, such that the member and the extension may be used with a fastener having an elongated threaded shaft extending outwardly from the fastener, the threaded shaft being received in the hollow body of the extension.

21. An extension between a driving tool and a member to be driven, the extension comprising, in combination:

a hollow body having a first end and a second end, means on the first end of the body for the extension to be releasably retained in the driving tool, means on the second end of the body to releasably retain the member to be driven, a sleeve being slidingly received within the hollow body, the sleeve having a first end having a flange formed thereon, the flange extending over the first end of the body, a second end of the sleeve being retained with the body, the sleeve having a sidewall, at least one retaining tab and at least one friction tab being formed one sidewall of the sleeve, and extending outwardly therefrom, the sleeve being longitudinally slidable within the body from a first position in which the sleeve is fully inserted within the body and a second position in which the sleeve is slid outwardly from the body, and wherein the driven member may be ejected from the body by sliding the sleeve into the first position.

22. The extension of claim 21, wherein the hollow body has at least one step formed on an internal wall thereof, such that when the sleeve is introduced into the hollow body, the at least one retention tab is deflected to pass the at least one step and returns to retain the sleeve within the hollow body.

23. The extension of claim 21, wherein the at least one friction tab slidingly engages the hollow body providing a friction fit between the sleeve and the hollow body.

24. The extension of claim 21, wherein a respective U-shaped slot is formed in the sidewall of the sleeve adjacent to the outwardly extending portion of each retaining tab and each friction tab such that each tab may be flexible and contact the hollow body.

25. In combination with a low-profile ratchet wrench, the wrench having a head portion formed with an opening, wherein a pawl is provided with gear teeth projecting within the opening in the head portion of the ratchet wrench, and wherein a selected one of a plurality of wrench sockets is removably received within the opening, each of the wrench sockets having external gear teeth meshing with the gear teeth on the pawl, an extension member having a pair of end portions, one of the end portions of the extension member being provided with external gear teeth meshing with the gear teeth on the pawl, and the other end portion of the extension member having a socket formed therein, the socket being provided with internal gear teeth meshing with the external gear teeth on the selected one of the wrench sockets.

26. The combination of claim 25, wherein the opening in the head portion of the wrench comprises a through opening.

27. The combination of claim 26, wherein the extension member comprises a hollow body.

28. The combination of claim 27, further including a sleeve slidably mounted within the hollow body, the sleeve having a pair of end portions, one of the end portions of the sleeve extending beyond the through opening and above the head portion of the ratchet wrench, whereby the sleeve may be manually depressed, and the other end portion of the sleeve engaging the wrench socket.

29. The combination of claim 28, wherein, depending upon the degree of manual pressure exerted upon the sleeve, either the extension member with the wrench socket attached thereto may be ejected from the head portion of the ratchet wrench, or else merely the wrench socket may be ejected from the extension member and the extension member may be retained within the head portion of the ratchet wrench.

30. Alternative method of using an extension member between a ratchet wrench and a selected wrench socket, the extension member being hollow and having a first end and an opposite second end, a sleeve slidably mounted in the hollow extension member, the sleeve having a first end disposed near the first end of the extension member, means to removably connect the selected socket wrench to the second end of the extension member, the ratchet wrench having a head portion having an opening therein; the method comprising the steps of:

removably connecting the selected wrench socket to the second end of the extension member, removably disposing the first end of the extension member in the opening in the ratchet wrench wherein the first end of the sleeve extends outwardly from the opening in the ratchet wrench, wherein ratcheting of the ratchet wrench drives the selected wrench socket, manually pressing against the first end of the sleeve wherein the selected wrench socket is released from the extension member, the extension member remaining connected to the ratchet wrench, and continuing manually pressing against the first end of the sleeve, wherein the extension member is released from the ratchet wrench, whereby, depending upon the degree of manual pressure exerted upon the sleeve, either the selected wrench socket may be ejected from the extension member and the extension member may be retained within the head portion of the ratchet wrench, or the extension member may be ejected from the head portion of the ratchet wrench.

* * * * *